US007077511B2

(12) United States Patent
Machida et al.

(10) Patent No.: US 7,077,511 B2
(45) Date of Patent: Jul. 18, 2006

(54) HOUSING USED IN INKJET HEAD

(75) Inventors: Osamu Machida, Hitachinaka (JP); Tomohiko Koda, Hitachinaka (JP); Satoru Tobita, Hitachinaka (JP); Yoshitaka Akiyama, Hitachinaka (JP); Toshiharu Sumiya, Hitachinaka (JP); Yoshikane Matsumoto, Hitachinaka (JP)

(73) Assignee: Ricoh Printing Systems Ltd., Tokyo (JP)

( * ) Notice: Subject to any disclaimer, the term of this patent is extended or adjusted under 35 U.S.C. 154(b) by 174 days.

(21) Appl. No.: 10/647,797

(22) Filed: Aug. 26, 2003

(65) Prior Publication Data

US 2004/0066431 A1 Apr. 8, 2004

(30) Foreign Application Priority Data

Aug. 26, 2002 (JP) ..... P2002-245630
Mar. 26, 2003 (JP) ..... P2003-086150
May 14, 2003 (JP) ..... P2003-135416

(51) Int. Cl.
*B41J 2/045* (2006.01)
*B21D 53/76* (2006.01)

(52) U.S. Cl. ..... 347/70; 347/68; 29/890.1

(58) Field of Classification Search ..... 347/68–73; 29/890.1
See application file for complete search history.

(56) References Cited

U.S. PATENT DOCUMENTS 5,818,482 A * 10/1998 Ohta et al. ..... 347/70
6,070,310 A * 6/2000 Ito et al. ..... 623/17.11

* cited by examiner

*Primary Examiner*—Manish Shah
*Assistant Examiner*—Geoffrey S. Mruk
(74) *Attorney, Agent, or Firm*—Whitham, Curtis, Christofferson & Cook P.C.

(57) ABSTRACT

A chamber support plate of an inkjet head is formed as a member different from a housing. The chamber support plate is formed with a plurality of grooves at high density by a dicing saw or the like. Piezoelectric elements are inserted into the grooves and adhered to a chamber plate. The plurality of grooves define comb teeth portions, which support the chamber plate at positions between adjacent piezoelectric elements.

6 Claims, 16 Drawing Sheets

HOUSING USED IN INKJET HEAD

BACKGROUND OF THE INVENTION

1. Field of the Invention

The present invention relates to a method of forming a housing used in an inkjet head with high nozzle density and an inkjet recording device that includes the housing.

2. Related Art

FIG. 1 shows an example of a conventional inkjet recording device disclosed in Japanese Patent-Application Publication No. SHO-58-119872 that uses deformation of a piezoelectric element to apply pressure to ink in a pressure chamber so as to eject an ink droplet from a nozzle that is in fluid communication with the pressure chamber.

The inkjet recording head of FIG. 1 includes a channel plate, a reinforcement plate 206, piezoelectric elements 204, and feet 224. The channel plate is made from a nozzle plate 201, a chamber plate 220, and a diaphragm plate 310 stacked on top of each other. The chamber plate 220 is formed with pressure chambers 200, and the nozzle plate 201 is formed with orifices 202. Each foot 224 is provided to one end of a corresponding one of the piezoelectric elements 204. The reinforcement plate 206 has a higher rigidity than the channel plate and is provided to improve the inter-chamber rigidity of the chamber plate 220. The reinforcement plate 206 connects to the diaphragm plate 310 at positions between adjacent feet 224 and also guides movement of the feet 224. When one of the piezoelectric elements 204 deforms, the corresponding foot 224 moves vertically. This applies pressure to the ink in the corresponding pressure chamber 200 and ejects an ink droplet through the corresponding orifice 202. This type of head can be driven using a low voltage, can be produced with a fairly high nozzle density, and has excellent ejection characteristics. However, adjacent feet 224, and also adjacent piezoelectric elements 204, cannot be located too tightly together because the reinforcement plate 206 is interposed between adjacent feet 224. Because it has been difficult to form through holes, in which the feet 224 are inserted, in high density in the reinforcement plate 206, this configuration places limits on the nozzle density of the head.

FIG. 2 shows an inkjet recording head, disclosed in Japanese Patent-Application Publication No. HEI-6-8422, proposed for overcoming the above-described problem. The inkjet recording head of FIG. 2 includes a chamber plate 410 and a housing 412. The chamber plate 410 is formed with a row of pressure chambers 404. The housing 412 has greater rigidity than the chamber plate 410 and is formed with an opening 421 that extends in the same direction as the row of pressure chambers 404. A plurality of piezoelectric elements 402 are fixed to the chamber plate 410 at positions in the opening 421 that confront the pressure chambers 404. A fixing base 400 formed with a thin-film electrode 401 is attached to each piezoelectric element 402 so that a portion of the thin-film electrode 401 is in intimate contact with the corresponding piezoelectric element 402. A lead 403 is connected to an exposed surface of each thin-film electrode 401. When a voltage is supplied through the lead 403 to the corresponding piezoelectric element 402, the piezoelectric element 402 contracts in its lengthwise direction, that is, the direction indicated by an arrow Z in FIG. 2. When application of voltage is stopped, then the piezoelectric element 402 reverts to its initial state. Because no member is provided in between adjacent piezoelectric elements 402 for guiding the piezoelectric elements 402 in the configuration of FIG. 2, the piezoelectric elements 402 can be aligned in a much higher density than with the configuration of FIG. 1.

If the pressure chambers 404 are formed with a large width to ensure that ink droplets are sufficiently large, then the width of the opening 421 in the housing 412 must also be enlarged. This increases the cross-sectional surface area of the opening 421. Also, the recording head must be made longer in the nozzle row direction in order to increase the number of nozzles to increase print speed. This also increases the cross-sectional surface area of the opening 421.

However, the chamber plate 410 is extremely thin, that is, with a thickness of only about 0.8 mm to 1.0 mm. The section of the chamber plate 410 that is formed with the pressure chambers 404 has a total thickness of only about 0.4 mm to 0.6 mm. Accordingly, if the opening 421 of the housing 412 is too large, then deformation of any one of the piezoelectric elements 402 will deform the entire chamber plate 410 and not just the corresponding pressure chamber 404. The displacement generated by the piezoelectric elements 402 is not effectively used to eject ink droplets. Also, crosstalk can be generated between neighboring nozzles that reduces consistency in speed of ejected ink droplets or otherwise degrades ejection characteristic. Crosstalk can become particularly serious when a great number of piezoelectric elements 402 are driven simultaneously. When neighboring pressure chambers 404 are affected by the deformed simultaneously with a pressure chamber 404 that is driven to eject ink, the ink meniscus in nozzles corresponding to the neighboring pressure chambers 404 can vibrate.

Further, the center of the chamber plate 410 can be deformed by pressure applied by the piezoelectric elements 402 while the piezoelectric elements 402 are brought into attachment with the chamber plate 410 so as to fix the piezoelectric elements 402 to the chamber plate 410. This deformation can change the ejection characteristics at the nozzles near the center of the head to differ from those near the ends of the head.

SUMMARY OF THE INVENTION

In the view of foregoing, it is an object of the present invention to overcome the above problems, and also to provide an inkjet recording head that is easy to assemble, wherein piezoelectric elements can be consistently positioned with respect to the pressure chambers, and that has uniform and consistent ejection characteristics, and to provide a recording device that includes the inkjet recording head.

In order to attain the above and other objects, the present invention provides an inkjet recording head including a chamber plate, a diaphragm adhered to the chamber plate, a housing having a first surface and a second surface opposing the first surface, and a plurality of actuators. The chamber plate is formed with a plurality of pressure chambers filled with ink and aligned in a row that extends in a first direction. The first surface of the housing is adhered to the diaphragm. The first surface of the housing is formed with a plurality of first grooves that extend in a second direction perpendicular to the first direction. The first grooves confront the pressure chambers with the diaphragm interposed between the first grooves and the pressure chambers. The second surface is formed with a second groove that extends in the first direction. The first grooves intersect the second groove at positions that confront the pressure chambers. A plurality of through holes that extend from the first surface through to the second surface of the housing are formed where the first grooves intersect the second groove. The plurality of actuators are housed in the through holes, and one end of each actuator is adhered to the diaphragm.

There is also provided an inkjet recording device including a head unit that includes a plurality of above-described inkjet recording heads. The plurality of inkjet recording heads are aligned in a row.

There is also provided a method of forming a housing used in an inkjet recording head formed with a plurality of pressure chambers that are aligned in a lengthwise direction. The method includes the steps of forming a first groove in a first surface of a plate, the first groove extending in the lengthwise direction, and forming a plurality of second grooves in a second surface of the plate that is opposite from the first surface. The second grooves each extend in a widthwise direction that is perpendicular to the lengthwise direction and intersect with the first groove at positions that correspond to the pressure chambers. The second grooves are formed to connect with the first groove where the second grooves intersect the first groove to form a plurality of through holes at positions that correspond to the pressure chambers.

There is also provided a method of forming a housing used in an inkjet recording head formed with a plurality of pressure chambers that are aligned in a lengthwise direction. The method includes the steps of forming a groove into a first surface of a plate, the first groove extending in the lengthwise direction and forming a thin region in the plate, and punching a plurality of through holes through the thin region. The through holes are formed at a predetermined pitch.

There is also provided an inkjet recording head including a chamber plate, a diaphragm, a housing, and a plurality of actuators. The chamber plate is formed with a plurality of pressure chambers filled with ink. The pressure chambers are aligned in a row that extends in a lengthwise direction. The diaphragm is adhered to the chamber plate. The housing has a first surface adhered to the diaphragm and is formed with a plurality of through holes at positions corresponding to the pressure chambers with the diaphragm interposed between the through holes and the pressure chambers. The plurality of actuators are disposed in the through holes, and one end of each actuator being adhered to the diaphragm. The housing is produced in a method including the steps of forming a groove into a first surface of a plate, the first groove extending in the lengthwise direction and forming a thin region in the plate, and punching a plurality of through holes through the thin region, the through holes being formed at a predetermined pitch.

There is also provided an inkjet recording head and a recording device including the inkjet recording head. The inkjet recording head includes a chamber plate formed with a plurality of pressure chambers aligned in a row, a set of piezoelectric elements fixed to the chamber plate at positions that correspond to the pressure chambers in the chamber plate, a housing that supports the chamber plate, and a support member including a comb-shaped section divided into a plurality of teeth. The comb-shaped section is adhered to the chamber plate with the teeth interposed between adjacent ones of the piezoelectric elements.

BRIEF DESCRIPTION OF THE DRAWINGS

In the drawings:

FIG. 6(*b*) is a cross-sectional view showing the member of FIG. 6(*a*) formed with grooves;

FIG. 6(*c*) is a cross-sectional view showing the member of FIG. 6(*b*) after the wall formed with the grooves is ground down;

FIG. 9(*b*) is a cross-sectional view showing the member of FIG. 9(*a*) formed with grooves;

FIG. 9(*c*) is a cross-sectional view showing the member of FIG. 9(*b*) after the grooves, with the exception of through holes of the member, are filled with a resin;

FIG. 9(*d*) is a cross-sectional view showing the member of FIG. 9(*c*) after the wall formed with the grooves is ground down;

FIG. 12(*a*') is view showing the lower surface the member of FIG. 12(*a*);

FIG. 12(*b*) is a cross-sectional view showing the member of FIG. 12(*a*) being formed with through holes using the punch of FIG. 11;

FIG. 12(*b*') is view showing the lower surface the member of FIG. 12(*b*);

FIG. 12(*c*) is a cross-sectional view showing the member of FIG. 12(*b*) after the through holes have been punched therethrough;

FIG. 12(*c*') is view showing the lower surface the member of FIG. 12(*c*);

FIG. 13(*b*) is a cross-sectional view showing the member of FIG. 13(*a*) being formed with odd-number through holes using a group of punches;

FIG. 13(*c*) is a cross-sectional view showing the member of FIG. 13(*a*) being formed with even-numbered through holes using the group of punches of FIG. 13(*b*);

FIG. 13(*d*) is a cross-sectional view showing the member of FIG. 12(*c*) after both odd-numbered and even-numbered through holes have been punched therethrough;

PREFERRED EMBODIMENTS OF THE PRESENT INVENTION

Next, inkjet recording devices according to embodiments of the present invention will be described with reference to the attached drawings.

Figure 3:
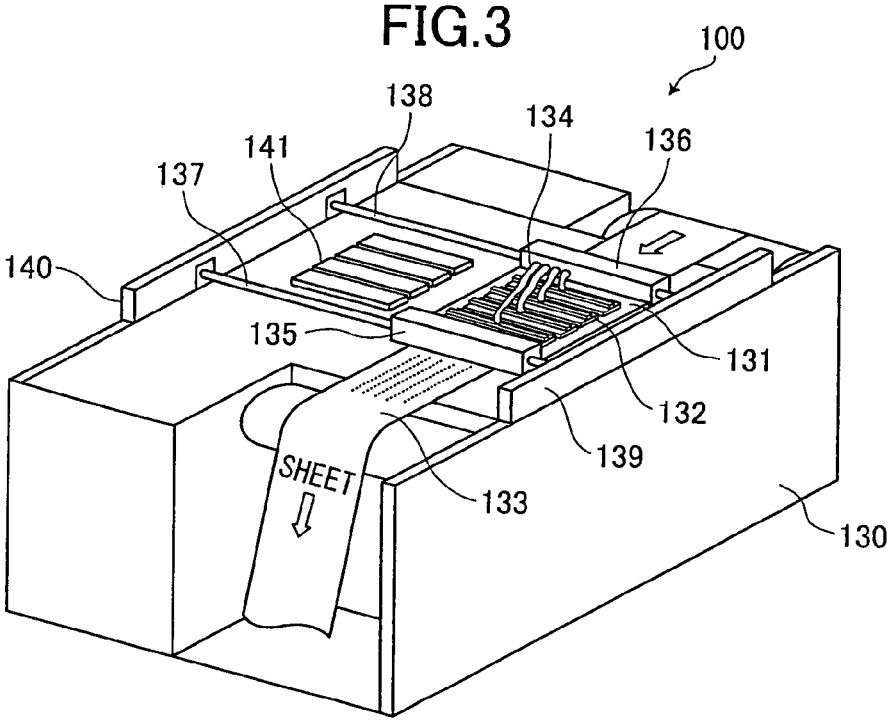
FIG. 3 is a perspective view showing an inkjet recording device according to an embodiment of the present invention.

First, an inkjet recording device 100 according to a first embodiment of the present invention will be described. As shown in FIG. 3, the inkjet recording device 100 includes a casing 130 and a head base 131. Although not shown in the drawings, a roll-sheet transport unit and a control unit are housed in the casing 130. Also, a roll-sheet supply unit is disposed at the rear side of the casing 130. The roll-sheet transport unit transports a roll sheet 133 supplied from the roll-sheet supply unit in the direction indicated by arrows in FIG. 3.

Frames 139, 140 are formed at the upper left and right sides of the casing 130. Rods 137, 138 are supported between the frames 139, 140. Support members 135, 136 are slidably supported on the rods 137, 138. The head base 131 is attached to the support members 135, 136. Four head units 132 are supported on the head base 131. The support members 135, 136 are slidable in the widthwise direction of the roll sheet 133 to move the head units 132 to the position of a head cleaning mechanism 141.

The four head units 132 are supplied with cyan-, magenta-, yellow-, and black-colored ink, respectively, from ink tanks (not shown) through four ink supply tubes 134. Also, each of the head units 132 includes a plurality (20 in this example) of inkjet heads 32A (FIG. 4) aligned in the widthwise direction of the roll sheet 133.

Figure 4:
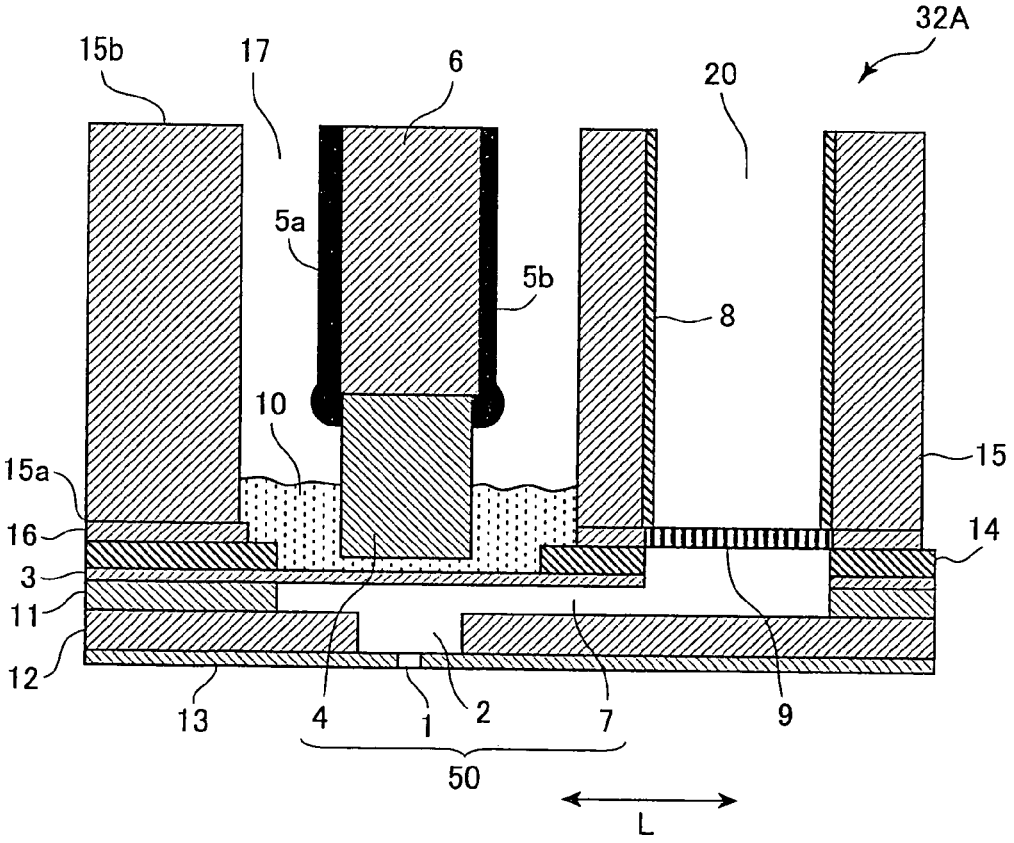
FIG. 4 is a cross-sectional view showing an inkjet head of the inkjet recording device of FIG. 3.

As shown in FIG. 4, each of the inkjet heads 32A includes an orifice plate 13, a pressure chamber plate 12, a restrictor plate 11, a diaphragm 3, a support plate 14, a filter plate 16, and a housing 15 stacked one on top of the other and adhered together in this order from the bottom. The orifice plate 13 is formed with a plurality of orifices 1 (only one orifice is shown in FIG. 4). A plurality of pressure chambers 2 are formed in the pressure chamber plate 12 in fluid communication with the corresponding orifices 1. A plurality of restrictors 7 are formed in the restrictor plate 11. A filter 9 is formed in the filter plate 16. Piezoelectric elements 4 are inserted in an opening 17 of the housing 15. One end of each piezoelectric element 4 is connected to the diaphragm 3 by a resilient adhesive 10 such as silicone adhesive. The other end of each piezoelectric element 4 is fixed to a piezoelectric element fixing plate 6. A pair of signal input terminals 5*a*, 5*b* are provided on opposite sides of each piezoelectric element fixing plate 6 and extend to the side surfaces of the corresponding piezoelectric element 4. When a potential difference is applied between any pair of signal input terminals 5*a*, 5*b*, the corresponding piezoelectric element 4 contracts. The piezoelectric element 4 reverts to its initial state once application of the electric potential is stopped. A common ink channel 20 is also formed in the housing 15. An ink supply tube 8 is provided within the common ink channel 20 to prevent ink from leaking out from the common ink channel 20. The support plate 14 serves to reinforce the diaphragm 3.

Each orifice 1, pressure chamber 2, restrictor 7, and piezoelectric element 4 configure a nozzle 50. Each of the inkjet heads 32A includes 128 nozzles 50. The nozzles 50 are juxtaposed in a widthwise direction W of the housing 15 as shown in FIG. 5, that is, in a direction perpendicular to the surface of the sheet on which FIG. 4 is drawn.

The diaphragm 3, the restrictor plate 11, the pressure chamber plate 12, and the support plate 14 are made from stainless steel. The orifice plate 13 is made from nickel or stainless steel. The piezoelectric element fixing plate 6 is made from an electrical insulating material, such as a ceramic or polyimide. The housing 15 is made from stainless steel (SUS).

The ink is supplied from the ink tank (not shown) to the common ink channel 20 and distributed to the restrictors 7 through the filter 9. The restrictors 7 control the flow of ink while ink is supplied to the pressure chambers 2 and the orifices 1. When a potential difference is applied between the pair of signal input terminals 5*a*, 5*b*, the corresponding piezoelectric element 4 contracts, which applies pressure to the ink in the corresponding pressure chamber 2 and ejects an ink droplet from the corresponding orifice 1.

Figure 5:
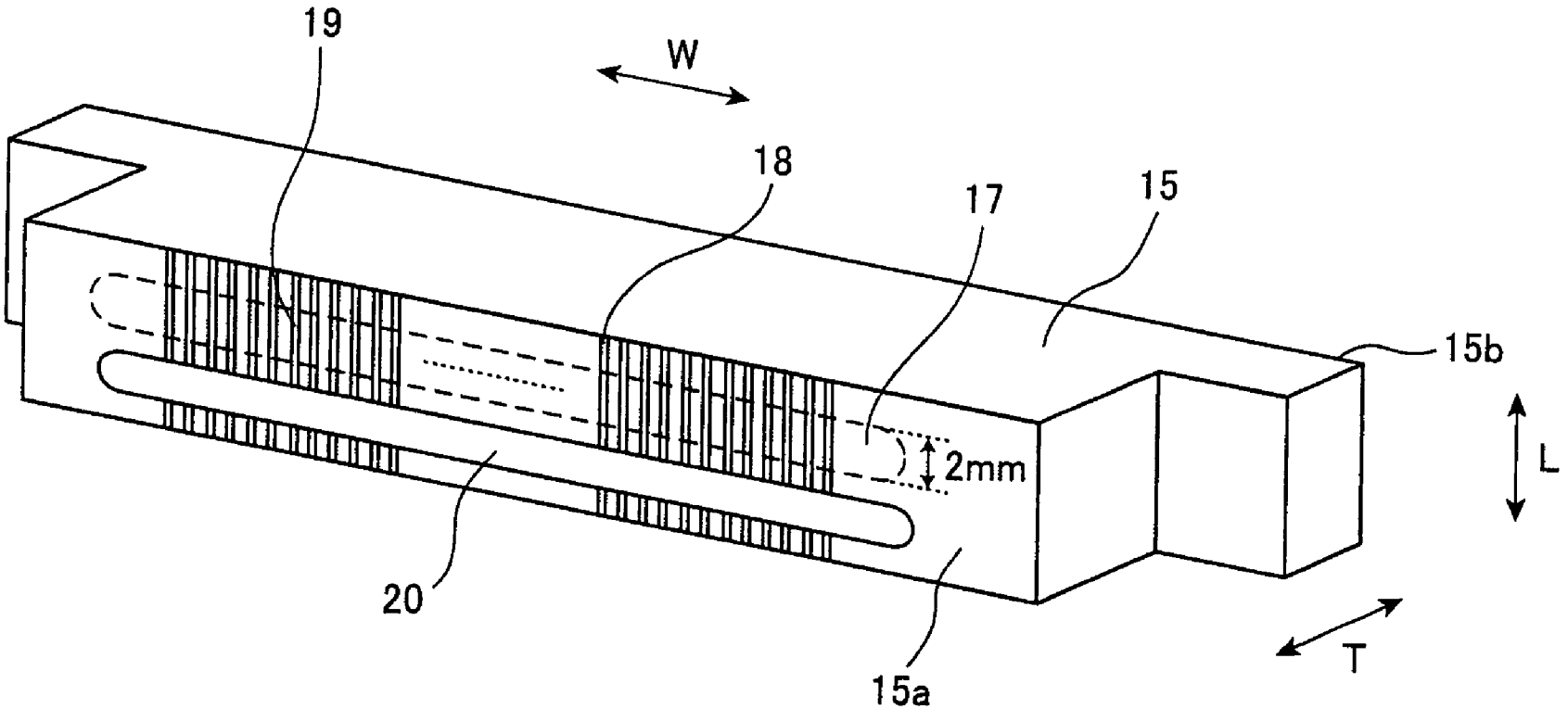
FIG. 5 is a perspective view showing a housing of the inkjet head of FIG. 4.

FIG. 5 is a perspective view of the housing 15. The housing 15 includes an upper surface 15*b* and a lower surface 15*a*. The lower surface 15*a* is adhered to the diaphragm 3. The upper surface 15*b* is formed with a groove 17 that extends in the widthwise direction W. The lower surface 15*a* is formed with a plurality of grooves 18 that extend in a lengthwise direction L and are located at positions that correspond to the pressure chambers 2. Through holes 19 are formed through the housing 15 at positions where the grooves 18 and the groove 17 intersect. Each of the through holes 19 is for receiving one of the piezoelectric elements 4. The common ink channel 20 penetrates completely through the housing 15 in a thickness direction T and extends in the widthwise direction W in parallel with the groove 17.

Figure 6A:
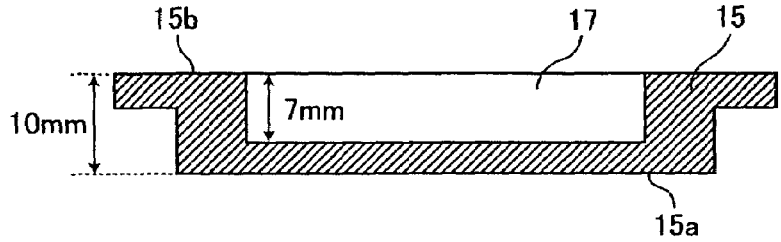
FIG. 6(*a*) is a cross-sectional view showing a member from which the housing of FIG. 5 is formed.
Figure 6B:
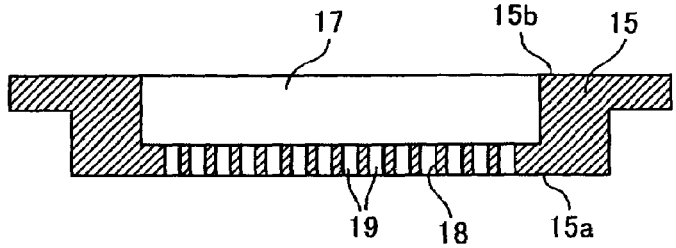
Figure 6C:
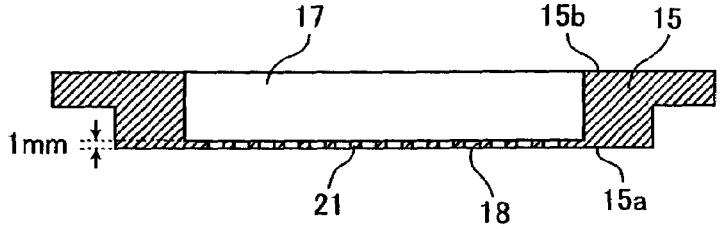

Next, a method of producing the housing 15 will be described with reference to FIGS. 6(*a*) to 6(*c*). First, a plate is prepared as shown in FIG. 6(*a*). The plate is made from stainless steel (SUS) to 10 mm thick. The groove 17 is formed in the upper surface 15*b* to a width of 2 mm and a depth of 7 mm. Although not shown in FIG. 6(*a*), a through hole that serves as the common ink channel 20 is formed through the plate. Next, as shown in FIG. 6(*b*), grooves 18 are formed in the lower surface 15*a* at positions that correspond to the pressure chambers 2. In the present example, 128 grooves 18 are formed at a pitch of 0.338 mm. Each of the grooves 18 is 3.5 mm deep. The grooves 18 are cut in the plate using a wire saw or a dicer with a blade having a width of 2 mm. By forming the groove 17 and the grooves 18 in the upper surface 15*b* and the lower surface 15*a*, respectively, the intersecting sections of the groove 17 and the grooves 18 form through holes 19. Each through hole 19 penetrates through the housing 15 in the thickness direction T and has a length of 2 mm in the direction L and a width of 0.25 mm in the direction W.

As shown in FIG. 6(*c*), the lower surface 15*a* of the housing 15 is then ground down until the thin sections 21 around the through holes 19 are a thickness of 1 mm. The lower surface 15*a* desirably has a flatness of 10 microns or less to avoid undesirable influence to the gap between the piezoelectric element 4 and the diaphragm 3. In this embodiment, the lower surface 15*a* is ground down to a flatness of 5 microns. It should be noted that the thickness of the thin sections 21 need not have a thickness of 1 mm, but need only be thinner than the length of the piezoelectric elements 4.

The lower surface 15*a* of the housing 15 is coated with adhesive by spray, transfer, or some other method, and then adhered to the diaphragm 3. As a result, as shown in FIG. 4, the restrictor plate 11, providing side walls of the pressure chambers 2, is adhered to the thin sections 21 through the diaphragm 3. This increases the rigidity of the pressure chambers 2 so that crosstalk among the nozzles 50 can be suppressed. Experiments were performed to investigate the influence that the number of simultaneously driven nozzles 50 has on ink ejection speed in the inkjet heads 32A. The results of the experiments are plotted in the graph of FIG. 7.

Figure 7:
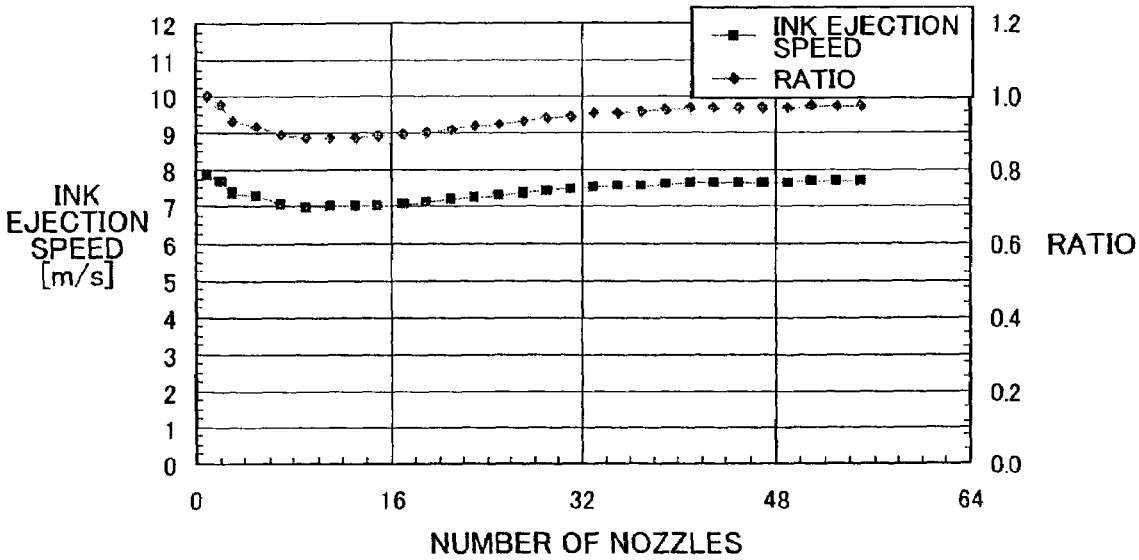
FIG. 7 is a graph representing the relationship between ejection speed of ink droplets to the number of nozzles driven in an inkjet head according to the present invention.

It can be understood from the graph of FIG. 7 that the inkjet heads 32A achieve proper ink ejection characteristics, with insignificant variation in ink ejection speed even if the number of simultaneously driven nozzles 50 is increased. This is because, as described previously, the side wall (restrictor plate 11) of the pressure chamber 2 is adhered to the thin sections 21 through the diaphragm 3. The thin sections 21 increase the rigidity of the pressure chambers 2 so that interference between nozzles 50 can be suppressed.

With the configuration of the present embodiment, the small through holes 19 can be formed at the locations of the pressure chambers 2 easily and with great precision. Also, the pressure chambers 2 have higher rigidity because the thin sections 21 serving as the side walls between adjacent through holes 19 are adhered to the diaphragm 3. Therefore, interference between adjacent nozzles 50 can be prevented, and thus degradation in image quality in association with decrease in ink ejection speed because of such interference can be prevented. Further, the plurality of through holes 19 are formed by forming the groove 17 and the grooves 18, without the need for machine work to open each hole 19 separately. Therefore, the nozzles 50 can be formed in a high density.

Figure 8:
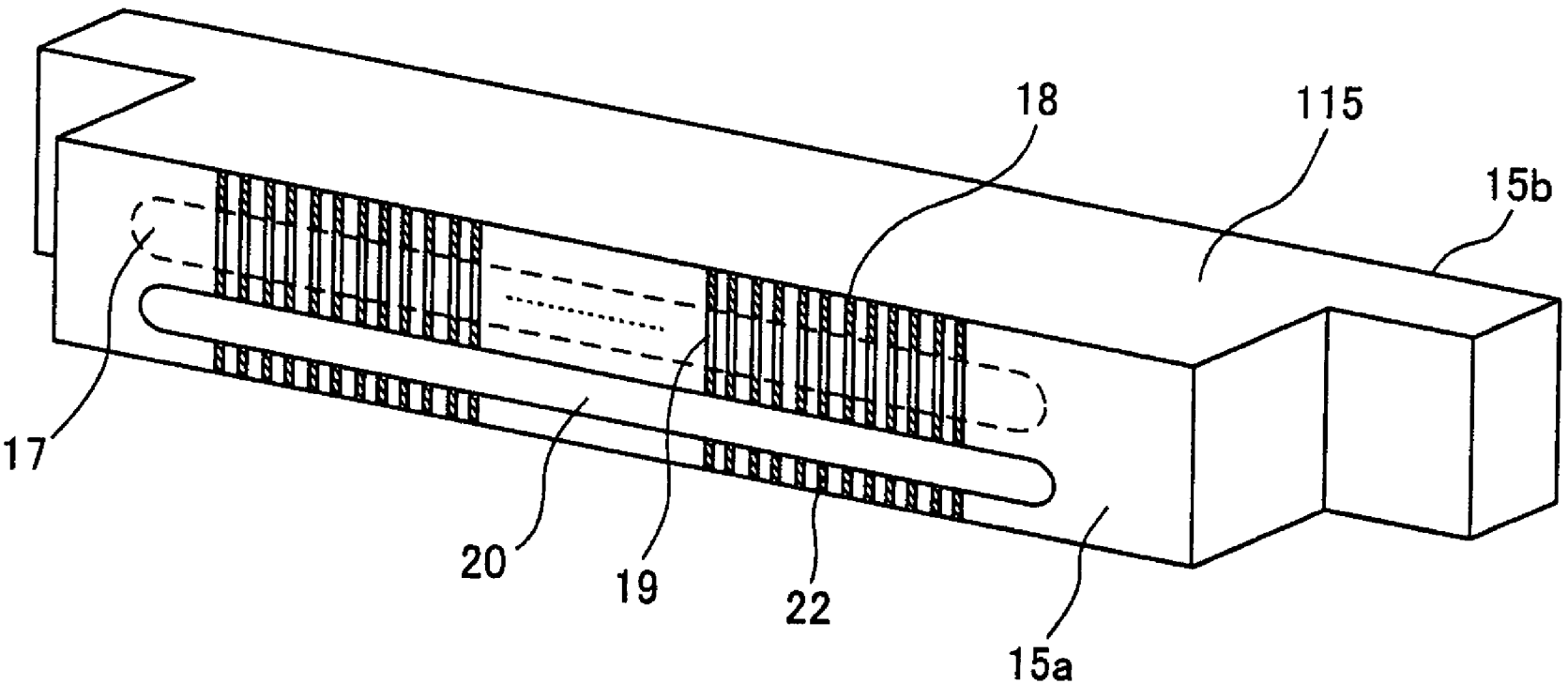
FIG. 8 is a housing according to a second embodiment of the present invention.
Figure 9A:
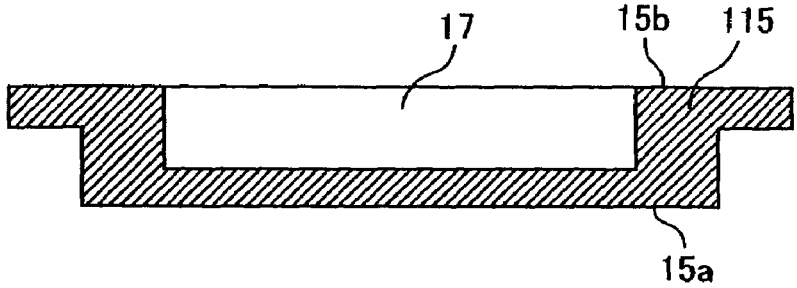
FIG. 9(*a*) is a cross-sectional view showing a member from which the housing of FIG. 8 is formed.
Figure 9B:
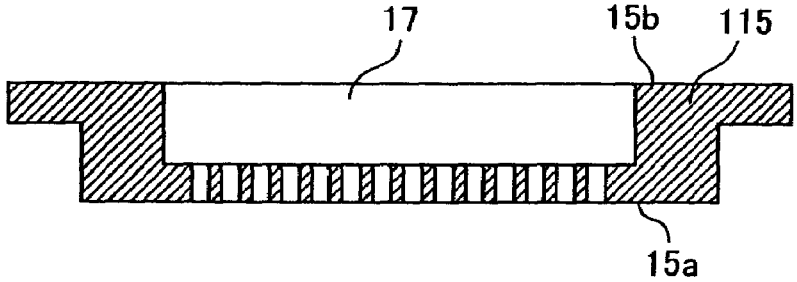
Figure 9C:
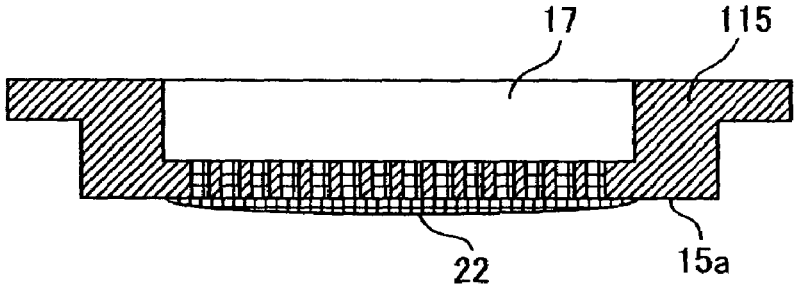
Figure 9D:
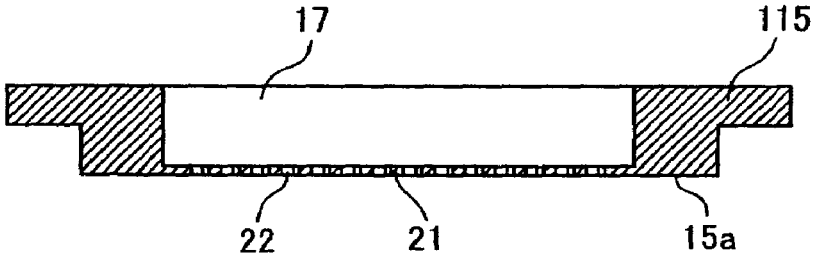

Next, an inkjet head according to a second embodiment of the present invention will be described. The inkjet head according to the present embodiment differs from that of the first embodiment in that the inkjet head of the present embodiment includes a housing 115 shown in FIG. 8. The housing 115 is similar to the housing 15, but differs in that the grooves 18 of the housing 115 are filled with resin 22 except for portions that correspond to the through holes 19. With this configuration, the lower surface 15*a* of the housing 115 is adhered to the diaphragm 3 from all four directions around each through hole 19, so that the rigidity of the pressure chambers 2 is further increased. Accordingly, inconsistency in ejection speed caused by interference between nozzles 50 can be even more effectively prevented so that good quality images can be achieved. Also, the edge of the common ink channel 20 is adhered to the diaphragm 3 on the same plane as the lower surface 15*a*. Therefore, the common ink channel 20 will be sufficiently rigid without the need to provide the ink supply tube 8.

Next, a method for producing the housing 115 will be described with reference to FIGS. 9(*a*) to 9(*d*). First, as shown in FIGS. 9(*a*) and 9(*b*), a 10 mm-thick plate made from stainless steel (SUS) is prepared. The groove 17 is opened in the upper surface 15*b* and the grooves 18 are formed in the lower surface 15*a*. Although not shown in FIGS. 9(*a*) and 9(*b*), a through hole that serves as the common ink channel 20 is formed through the plate. Next, as shown in FIG. 9(*c*), a resin 22, such as epoxy resin, is filled into the grooves 18 except for positions that correspond to the through holes 19. Then, the resin 22 is heated to 150° C. to cure the resin. Next, as shown in FIG. 9(*d*), the lower surface 15*a* of the housing 15 is ground down until the thin sections 21 around the through holes 19 are a thickness of 1 mm and the surfaces of the housing 115 and the resin 22 share the same plane. It should be noted that there are no particular limitations to what type of resin is used as the resin 22, but an example of suitable epoxy resin is Araldite Standard, produced by Vantico (Huntsman) Corp. The method used to cure the resin 22 should be selected as appropriate for the type of resin used.

Figure 10:
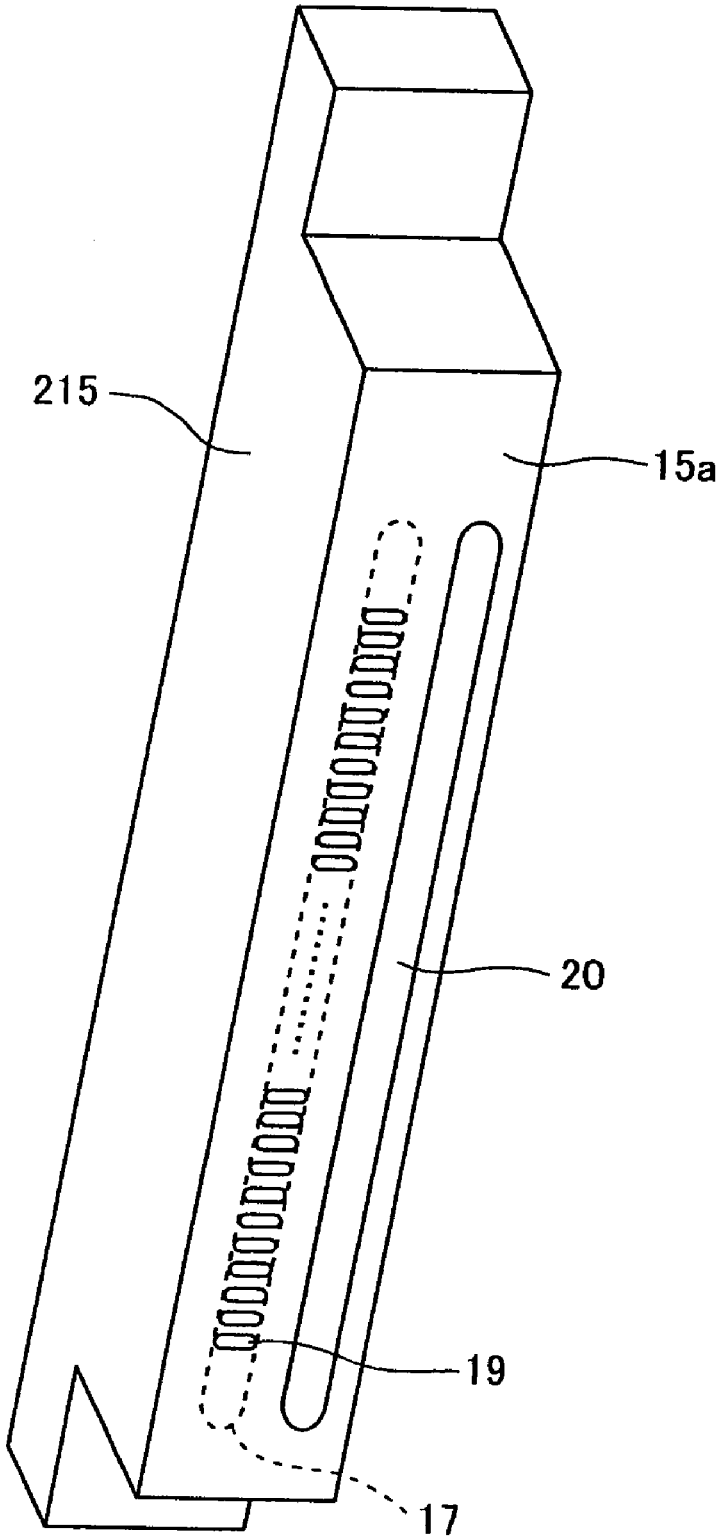
FIG. 10 is a perspective view showing a housing according to a third embodiment of the present invention.
Figure 11:
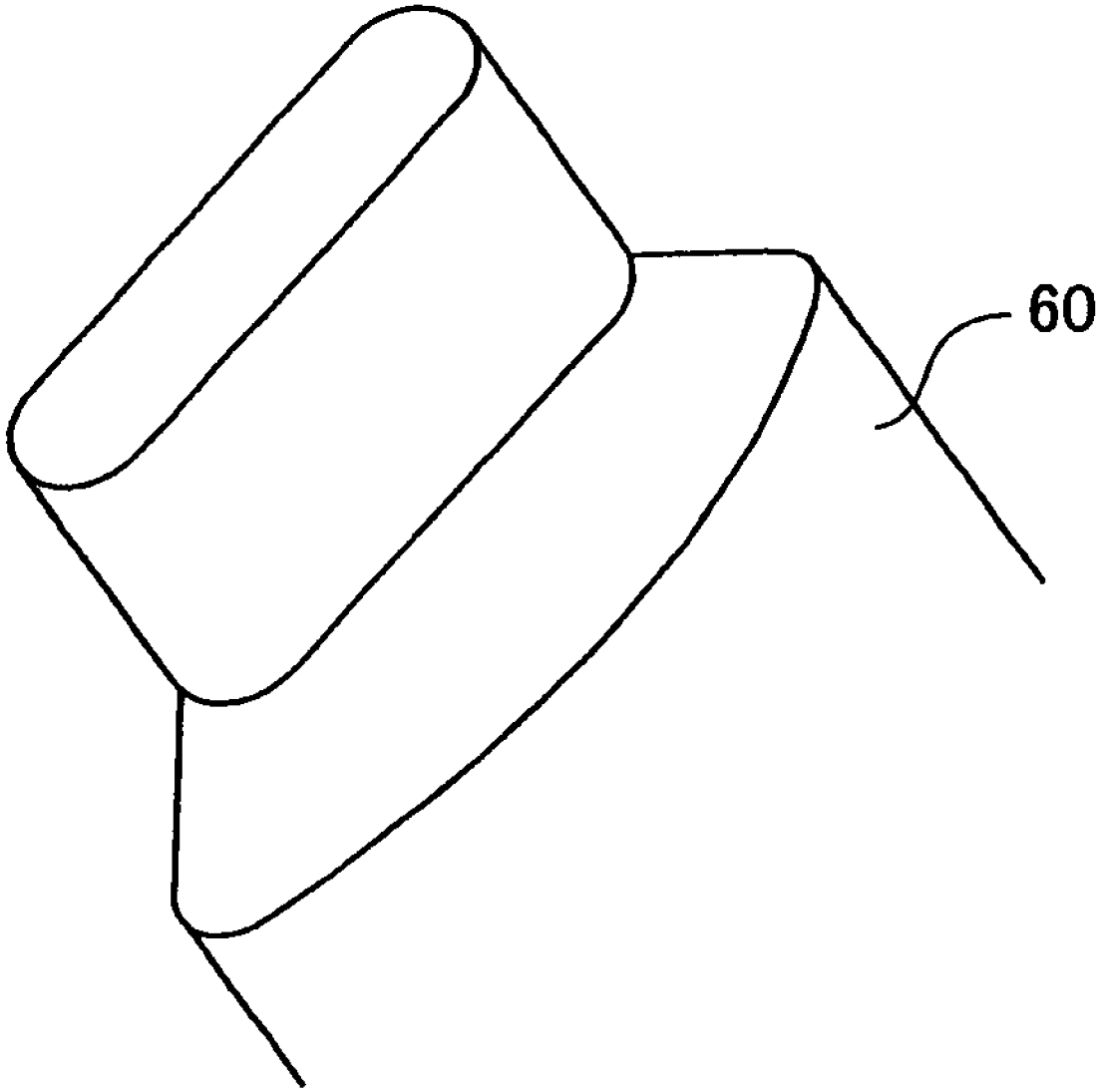
FIG. 11 is a perspective view showing a punch used when producing the housing of FIG. 10.
Figure 12A:
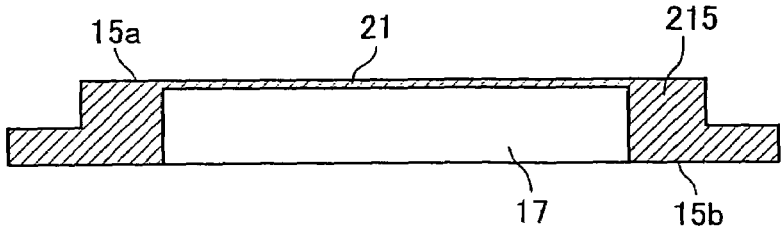
FIG. 12(*a*) is a cross-sectional view showing a member formed with a common ink channel and groove using a method according to the third embodiment.
Figure 12A:
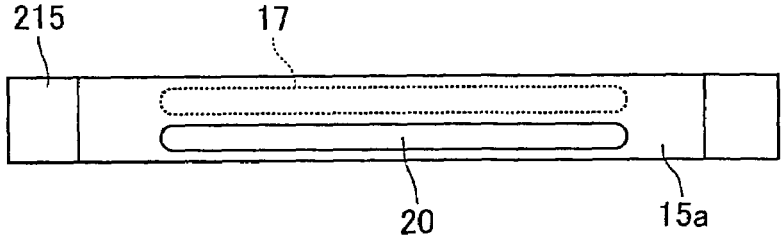
Figure 12B:
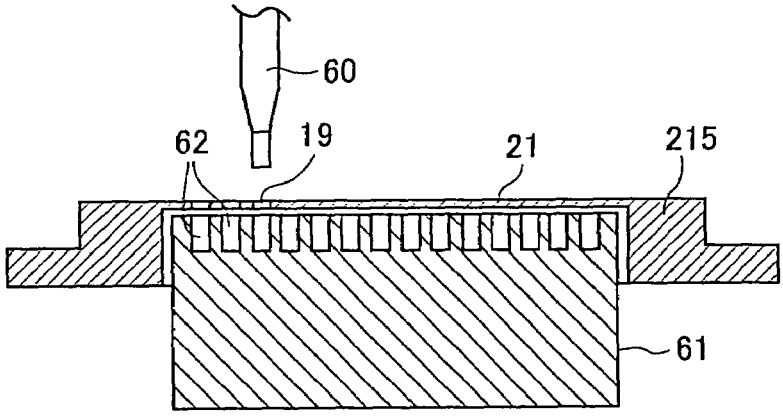
Figure 12B:
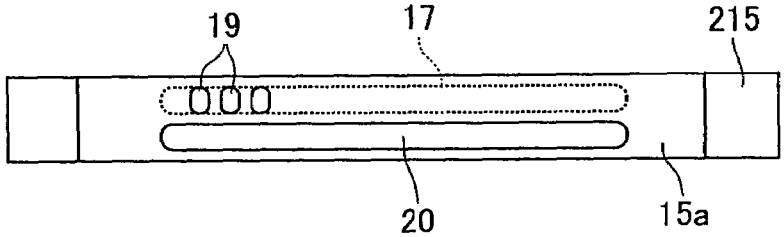
Figure 12C:
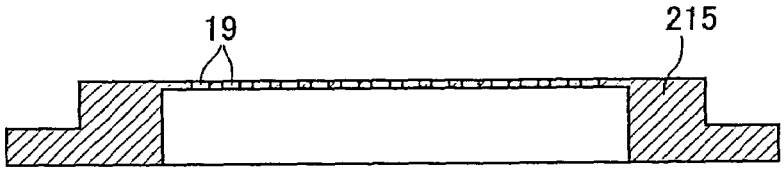
Figure 12C:
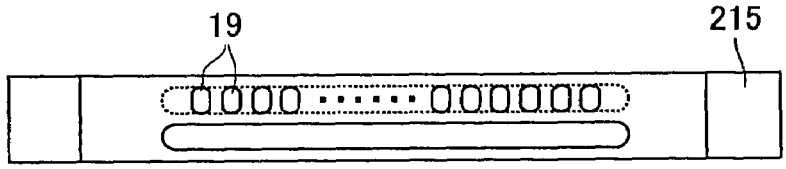
Figure 13A:
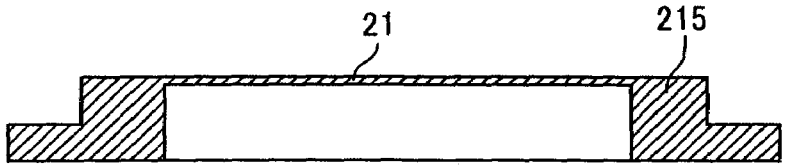
FIG. 13(*a*) is a cross-sectional view showing a member formed with a common ink channel and groove using a method according to a modification of the third embodiment.
Figure 13B:
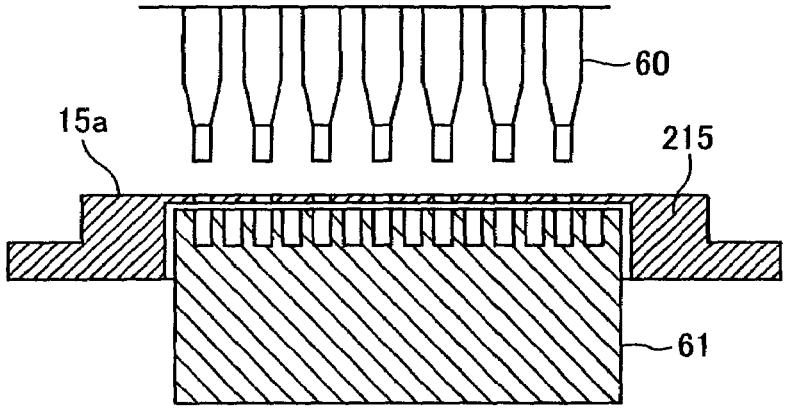
Figure 13C:
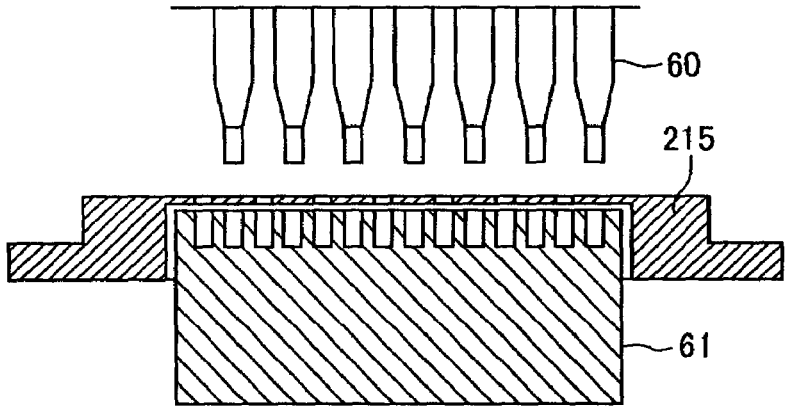
Figure 13D:
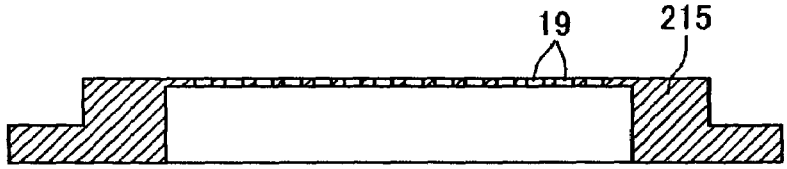

Next, an inkjet head according to a third embodiment of the present invention will be explained. The inkjet head according to the present embodiment differs from that of the first embodiment in that the inkjet head of the present embodiment uses a housing 215 shown in FIG. 10. The housing 215 is formed with the groove 17 and the common ink channel 20 in the same manner as the housing 15. However, the through holes 19 are formed using a punch 60 shown in FIG. 11. More specifically, a 10 mm-thick plate made from stainless steel (SUS) is prepared. As shown in FIGS. 12(*a*) and 12(*a*'), the groove 17 is opened in the upper surface 15*b* to a depth of 7 mm to form a thin section 21, and a through hole that serves as the common ink channel 20 is formed through the plate. Next, as shown in FIGS. 12(*b*) and 12(*b*'), the housing 215 is oriented with the lower surface 15*a* facing upward, and a lower die 61 is disposed within the groove 17. The lower die 61 is preformed with grooves 62 separated by a predetermined pitch. Then, the punch 60 is used to open the through holes 19 in the thin section 21. After a predetermined plurality of through holes 19 are formed as shown in FIGS. 12(*c*) and 12(*c*'), the lower die 61 is removed from the housing 215, and the housing 215 is ground to a smooth finish. In this way, the housing 215 can be easily formed using the punch 60 and the lower die 61.

It should be noted that a plurality through holes 19 may be opened simultaneously using a plurality of punches 60. That is, as shown in FIGS. 13(*a*) and 13(*b*), the lower die 61 is positioned in the groove 17 of a stainless steel plate formed with thin sections 21 in the same manner as described previously. Then, a plurality of punches 60 is used to form odd-numbered ones of the through holes 19. Then, the plurality of punches 60 is shifted slightly and used to form the even-numbered through holes 19 as shown in FIG. 13(*c*), thereby the housing 215 is completed after grinding as shown in FIG. 13(*d*). By forming a plurality of the through holes 19 simultaneously in this way, the time required for machining operations can be shortened. Also, dimensional error that results from stress generated during formation of the through holes 19 can be suppressed so that dimensional precision can be increased.

Next, an inkjet head 32B according to a fourth embodiment of the present invention will be described. It should be noted that parts of the inkjet head 32B that are the same as those of the inkjet head 32A will be described using the same numbering.

Figure 14:
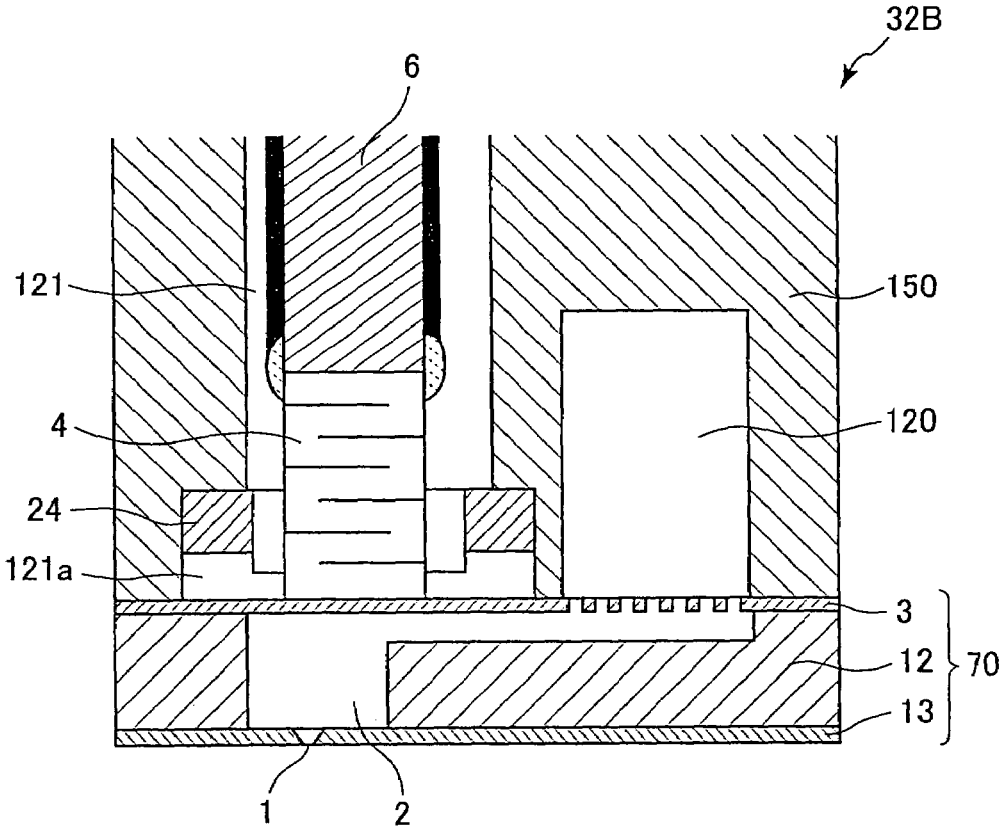
FIG. 14 is a cross-sectional view showing an inkjet recording head according to a fourth embodiment of the present invention.
Figure 16:
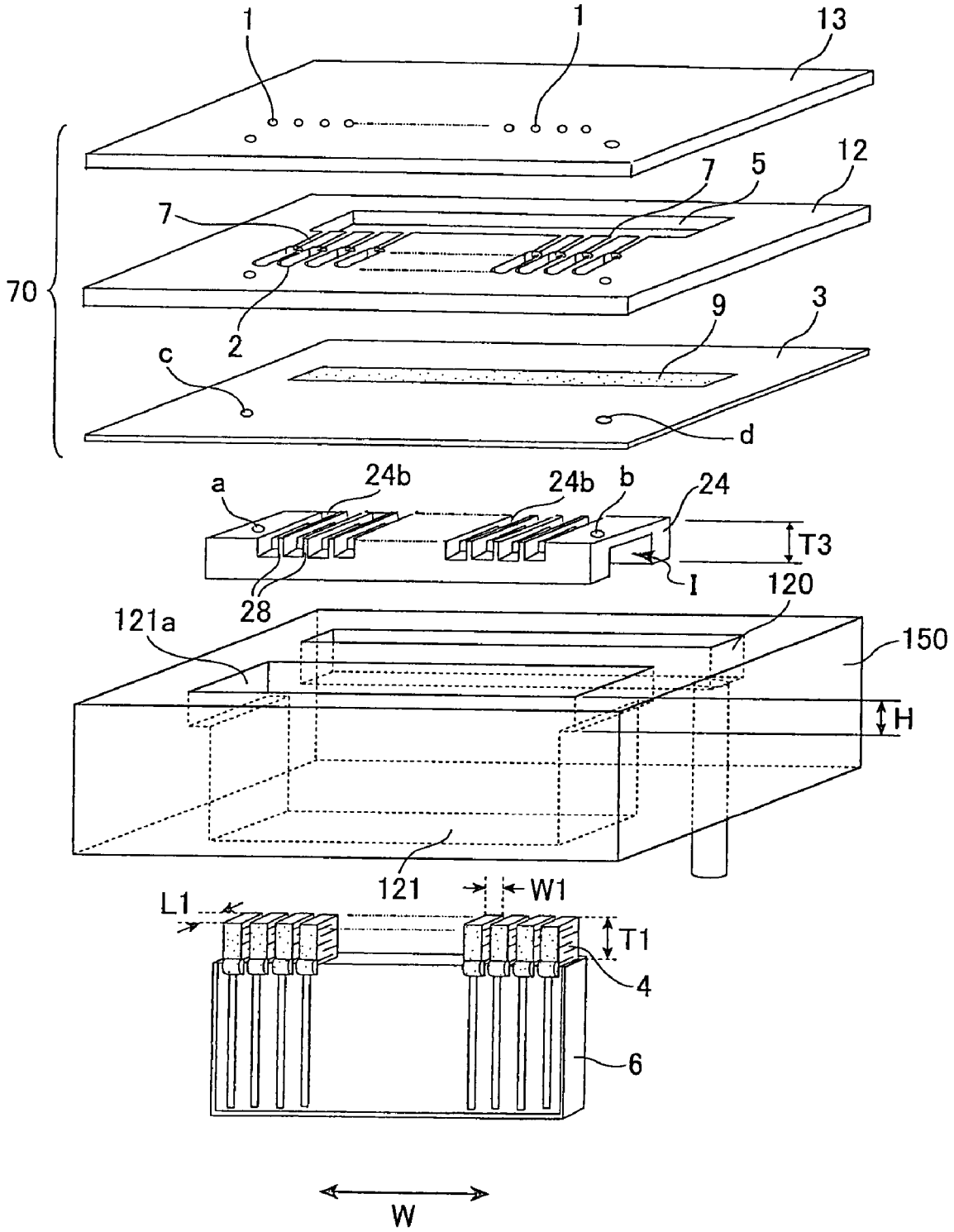
FIG. 16 is an exploded view showing the inkjet recording head according to the fourth embodiment.

As shown in FIG. 14, the inkjet head 32B includes a chamber plate 70, a housing 150, piezoelectric elements 4, a. piezoelectric element fixing plate 6, and a chamber support plate 24. The housing 150 is made from a highly rigid plate. As shown in FIG. 16, the chamber plate 70 includes an orifice plate 13, a pressure chamber plate 12, and a diaphragm 3. The orifice plate 13 is formed to a thickness of about 50 microns to 100 microns. The plurality of orifices 1 is formed using nickel electroforming, stainless steel press machining, plastic laser machining, or other operation.

The pressure chamber plate 12 has a thickness of 0.1 mm to 0.3 mm and is formed with a plurality of pressure chambers 2, a common ink chamber 5, and a plurality of restrictors 7. The pressure chambers 2 are provided in a one-to-one correspondence with the orifices 1. The restrictors 7 bring the pressure chambers 2 into fluid communication with the common ink chambers 5. The diaphragm 3 is made from a resin plastic plate or a stainless steel plate with a thickness of about 10 microns to 30 microns. The diaphragm 3 seals the pressure chambers 2 closed. The diaphragm 3 is formed with a filter 9 that filters out undesirable matter from the ink supplied from an ink tank (not shown).

As shown in FIG. 14, the housing 150 is formed with a manifold 120 and an opening 121. The opening 121 includes recesses 121a (FIG. 16). The piezoelectric elements 4 are disposed in the opening 121. One end of each piezoelectric element 4 is fixed to the piezoelectric element fixing plate 6 and the other end is adhered to the chamber plate 70 at a position in confrontation with the corresponding pressure chamber 2.

Figure 17:
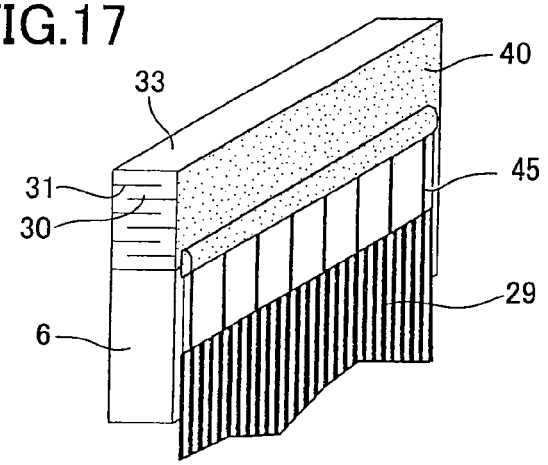
FIG. 17 is a perspective view showing a piezoelectric element of the inkjet recording head of FIG. 16.

The piezoelectric elements 4 are each a stack actuator, that is, each piezoelectric element 4 includes a plurality of piezoelectric layers that are d33 actuated. The piezoelectric elements 4 are produced in the following manner. As shown in FIG. 17, first a piezoelectric element member 33 is produced by alternately forming layers of piezoelectric material 30 and conductive material 31 on top of each other. Then, one end of the piezoelectric element member 33 is fixedly adhered to the piezoelectric element fixing plate 6. Electrodes 40 are formed on the piezoelectric element member 33, one to each of the broad oppositely facing surfaces of the piezoelectric element member 33. The free end of the piezoelectric element member 33, that is, the end opposite from the piezoelectric element fixing plate 6, is cut to form a comb shape, resulting in the plurality of piezoelectric elements 4 shown in FIG. 16. Examples of how to cut the piezoelectric element member 33 into the plurality of piezoelectric elements 4 include using a single dicing saw a plurality of times or using a wire saw a single time. According to the present embodiment, each piezoelectric element 4 is formed with a width W1 of 0.12 mm, a length L1 of 1.5 mm, and a height T1 of about 3 mm. Several tens of the piezoelectric elements 4 are formed at a pitch of 1/100 inch (254 microns). The electrodes 40 are connected to a flexible printed circuit (FPC) cable 29 by electrodes 45, which are provided on the piezoelectric element fixing plate 6.

Here, the piezoelectric element fixing plate 6 may be made from ceramics or other material formed with an electrode pattern that is used as the electrodes 45, or may be formed from a conductive material, such as stainless steel, and machined into a plate shape. Also, the piezoelectric elements 4 may be connected directly to the FPC cable 29 instead of coating the electrodes 40 on the piezoelectric element member 33.

Figure 15:
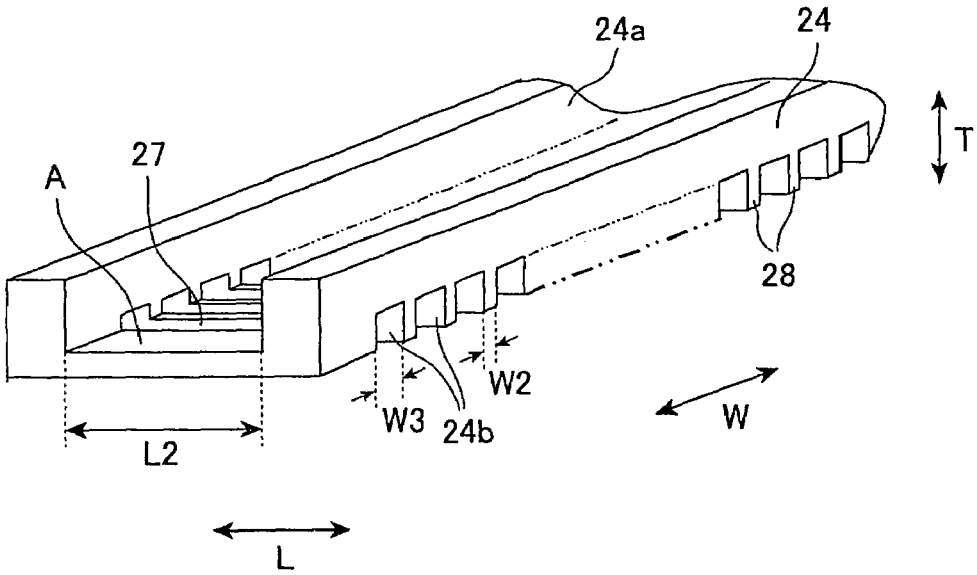
FIG. 15 is a perspective view showing a chamber support plate according to the fourth embodiment.

As shown in FIG. 14, the chamber plate 70 is adhered to the housing 150 and the piezoelectric elements 4 except for a non-adhered area around the pressure chambers 2. That is, the chamber plate 70 is adhered to neither the housing 150 nor the piezoelectric elements 4 at the non-adhered area. According to the present embodiment, the chamber support plate 24 is attached to the chamber plate 70 in this non-adhered area. As shown in FIG. 15, the chamber support plate 24 is formed in an angular C shape in cross section and divided into comb teeth portions 28 by grooves 24*b*.

A method of producing the chamber support plate 24 will be described with reference to FIG. 15. First, a groove 24*a* is formed in a plate-shaped member in the widthwise direction W, that is, the lengthwise direction of the plate-shaped member to form a generally angular-C-shaped member. Next, the angular-C-shaped member is formed with the plurality of grooves 24*b*. The grooves 24*b* extend through a lower surface A of the angular-C-shaped member in the thickness direction T and the lengthwise direction L. Forming the grooves 24*b* opens through holes 27 that extend in the thickness direction T of the chamber support plate 24. The grooves 24*a* and 24*b* can be formed easily and with great precision using a dicing saw or a wire saw. The grooves 24*b* are formed in a pitch that is the same as the pitch at which the member 33 is divided to form the piezoelectric elements 4 and also in a number that equals the number of piezoelectric elements 4. In this embodiment, each comb teeth portion 28 is formed with a width W2 of 0.094 mm, and each through hole 27 is formed with a width W3 of 0.16 mm and a length L2 of about 1.8 mm so that the piezoelectric element 4 can be inserted into the through hole 27. The completed chamber support plate 24 is formed with a rigidity that is the same as or greater than the rigidity of the chamber plate 70.

Next, a method for assembling the inkjet head 32B of the present embodiment will be explained with reference to FIG. 16. First, the orifice plate 13, the pressure chamber plate 12, and the diaphragm 3 are adhered together to form the chamber plate 70. Next, the chamber support plate 24 is adhered in the recesses 121*a* of the housing 150. The surfaces of the housing 150 and the chamber support plate 24 that are to be connected to the chamber plate 70, that is, the upper surfaces as viewed in FIG. 16, are machined to remove level difference between the housing 150 and the chamber support plate 24 and produce a flatness of 15 microns or less. The surfaces can be machined in this manner by grinding or lapping. According to experiments performed by the inventors, good droplet ejection can be maintained when flatness is 15 microns or less. However, when the flatness exceeds 15 microns, the overall chamber plate 70 can deform when the piezoelectric elements 4 are applied with voltage. This can decrease displacement efficiency of the piezoelectric elements 4 so that ink ejection characteristics can vary beyond the tolerance range.

Alternatively, the chamber support plate 24 can be formed with a thickness T3 which is shorter than a depth H of the recesses 121*a* of the housing 150 by in the range of 5 microns or less. With this configuration, the surfaces for connecting to the chamber plate 70, that is, the surface made from the housing 150 and the chamber support plate 24, will have a collective flatness of 5 microns or less from the point in time that the chamber support plate 24 is adhered to the recesses 121*a* of the housing 150. Therefore, the process of grinding or lapping after adhering the chamber support plate 24 to the housing 150 can be dispensed with so that the surface for connecting to the chamber plate 70 can be produced with relative ease.

The housing 150 and the chamber support plate 24 are desirably made from a metal, such as stainless steel, because metal is well adapted for machining. However, these components may be made of ceramic of molded from resin instead. Regardless of the material from which the housing 150 and the chamber support plate 24 are made, the housing 150 and the chamber support plate 24 are desirably provided with a rigidity that is equal to or greater than the rigidity of the chamber plate 70.

Next, the chamber plate 70 is fixed to the chamber support plate 24 and the housing 150. Positional shift between the through holes 27 in the chamber support plate 24 and the pressure chambers 2 can be minimized at this assembling step by aligning positioning portions a, b of the chamber support plate 24 with positioning portions c, d of the chamber plate 70. The positioning portions a, b, c, and d may be positioning holes or positioning protrusions.

Next, the free ends of the piezoelectric elements 4 that are fixed to the piezoelectric element fixing plate 6 are inserted into the through holes 27 of the chamber support plate 24 and adhered to the diaphragm 3. The piezoelectric element fixing plate 6 is adhered to the inner wall surface of the housing 150. This completes the inkjet head 32B.

With this configuration, the piezoelectric elements 4 deform when applied with a voltage. This generates a displacement that deforms the diaphragm 3 at the corresponding pressure chamber 2. Ink that fills the pressure chamber 2 is ejected from the corresponding orifice 1. At this time, the comb teeth portions 28 of the chamber support plate 24, which has high rigidity, support the chamber plate 70 against deformation. Because the chamber plate 70 deforms less, more of the displacement from the piezoelectric element 4 will be translated into volume change in the pressure chamber 2. Also, crosstalk that results from configuration of the head can be reduced, so that high quality image recording can be achieved.

Because the chamber support plate 24 is a separate member from the housing 150, the chamber support plate 24 can be easily machined. In particular, the grooves 24*b* can be easily and precisely machined using a dicing saw or a wire saw at a high density. Therefore, the plurality of the comb teeth portions 28 can be easily formed with high precision and at a high density. Accordingly, the existence of the chamber support plate 24 does not impede producing the piezoelectric elements 4 in a highly dense array. Therefore, the nozzles 50 can also be provided in a highly dense array. Also, because the chamber support plate 24 maintains the high rigidity of the chamber plate 70, crosstalk caused by structure of the head can be effectively prevented so that the head has high performance.

Because positional shift generated when the chamber plate 70 is fixed to the chamber support plate 24 and the housing 150 can be minimized by using the positioning portions a, b, c, d, the through holes 27 between adjacent comb teeth portions 28 formed in the chamber support plate 24 can be accurately positioned in relation to the pressure chambers 2 formed in the chamber plate 70. As a result, defective ejection or other problems caused by positional error during manufacture can be prevented.

Figure 18:
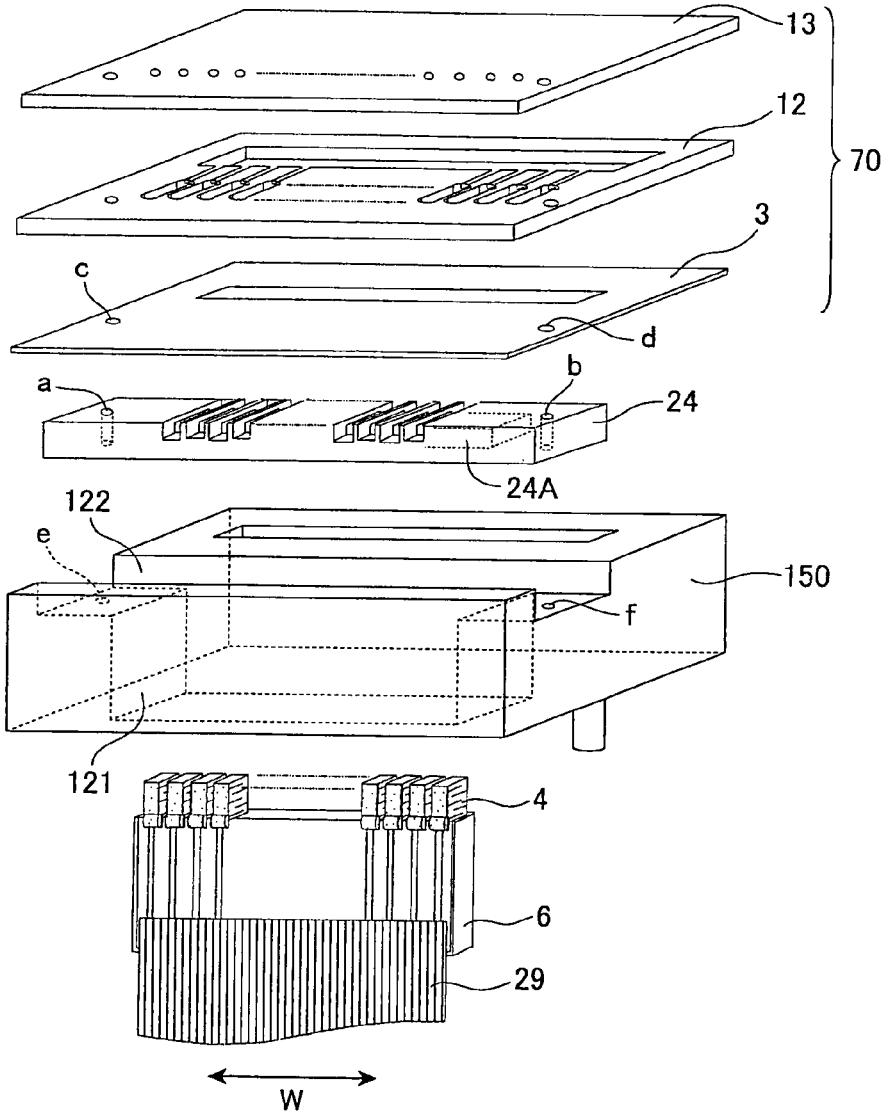
FIG. 18 is an exploded view showing an inkjet recording head according to a modification of the fourth embodiment.

Next, a modification of the inkjet head 32B will be explained with reference to FIG. 18. According to the modification, a groove 122 that extends in the widthwise direction W is formed in the housing 150. The chamber support plate 24 is formed with a space 24A instead of the groove 24*a*. The space 24A is dug out in a box-shape in one surface of the chamber support plate 24. The space 24A gives the chamber support plate 24 an angular C shape when viewed in cross section. With this configuration, ink can be prevented from entering the opening 121 of the housing 150. That is, when the chamber support plate 24 is configured as shown in FIG. 16, then ink, dust, or other undesirable matter may possibly enter the opening 121 of the housing 150 through an opening I of the chamber support plate 24 indicated by the arrow in FIG. 16. However, the configuration in the modification of FIG. 18 prevents ink from entering in the opening 121 because the configuration includes no opening I. Therefore, the piezoelectric elements 4 can be prevented from being damaged. Also, problems that occur from ink and the like entering between where the chamber support plate 24 and the housing 150 are adhered together can also be prevented. It should be noted that the chamber support plate 24 and the housing 150 can be precisely aligned together using the positioning portions a, b, e, and f shown in FIG. 18.

On the other hand, digging out one surface of the chamber support plate 24 in a box shape as described above increases manufacturing costs in order to achieve proper precision. Therefore, as an alternative, the chamber support plate 24 may be formed in the shape shown in FIG. 16 and the opening I can be filled with, for example, silicone or resin, after the chamber support plate 24 is adhered to the housing 150. This configuration achieves the same effects as the modification shown in FIG. 18.

Figure 19:
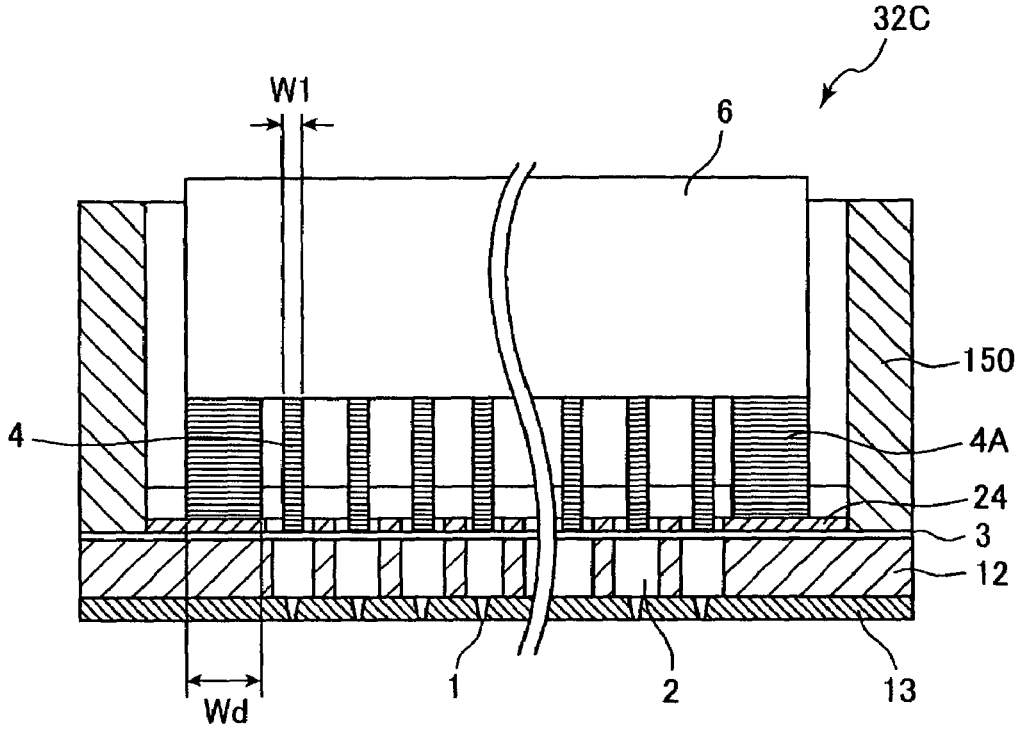
FIG. 19 is a cross-sectional view showing an inkjet recording head according to a fifth embodiment of the present invention.

Next, an inkjet head 32C according to a fifth embodiment of the present invention will be described with reference to FIG. 19. As shown in FIG. 19, dummy piezoelectric elements 4A that are not applied with voltage are provided on both sides of the piezoelectric elements 4. The dummy piezoelectric elements 4A are formed shorter than the piezoelectric elements 4. The surface of the free end of each dummy piezoelectric element 4A is fixed to the lower surface A (FIG. 15) of the chamber support plate 24.

Here, the chamber support plate 24 can be processed to have a surface with high flatness using grinding or lapping. Deviation in the thickness of the chamber support plate 24 can be suppressed to +/−5 microns. Further, by grinding or lapping the free end surface of each dummy piezoelectric element 4A, the deviation of a height difference between the piezoelectric elements 4 and the dummy piezoelectric elements 4A can be suppressed to +/−5 microns or less. Accordingly, the free end of each piezoelectric element 4 can be positioned properly with respect to the chamber plate 70 and adhered to the chamber plate 70 by abutting the free end surface of each dummy piezoelectric element 4A against the lower surface A. Positional deviation can be suppressed to 10 microns or less. Therefore, the piezoelectric elements 4 are less likely to press out (deform) the chamber plate 70 when the piezoelectric elements 4 are adhered to the chamber plate 70. Because the chamber support plate 24 has a high rigidity, the chamber plate 70 will not deform even if the dummy piezoelectric elements 4A abut against the chamber support plate 24. Therefore, the chamber plate 70 can be prevented from warping during manufacture so that ink droplet ejection performance will be more consistent.

The dummy piezoelectric elements 4A are desirably formed with a width Wd that is wider than the width W1 of each piezoelectric element 4. Because the dummy piezoelectric elements 4A bear almost all of the load required when adhering the dummy piezoelectric elements 4A to the lower surface A, if the dummy piezoelectric elements 4A are formed with an overly narrow width Wd, then the dummy piezoelectric elements 4A might be damaged if pressed against the chamber support plate 24 at a slight tilt during adhesion. By forming the dummy piezoelectric elements 4A with a large width Wd, the dummy piezoelectric elements 4A can bear a relatively large load so that damage can be prevented. Also, by forming the dummy piezoelectric elements 4A with a sufficiently large width Wd, the dummy piezoelectric elements 4A can be processed to form the above-mentioned level difference after the piezoelectric elements 4 are processed.

Figure 20:
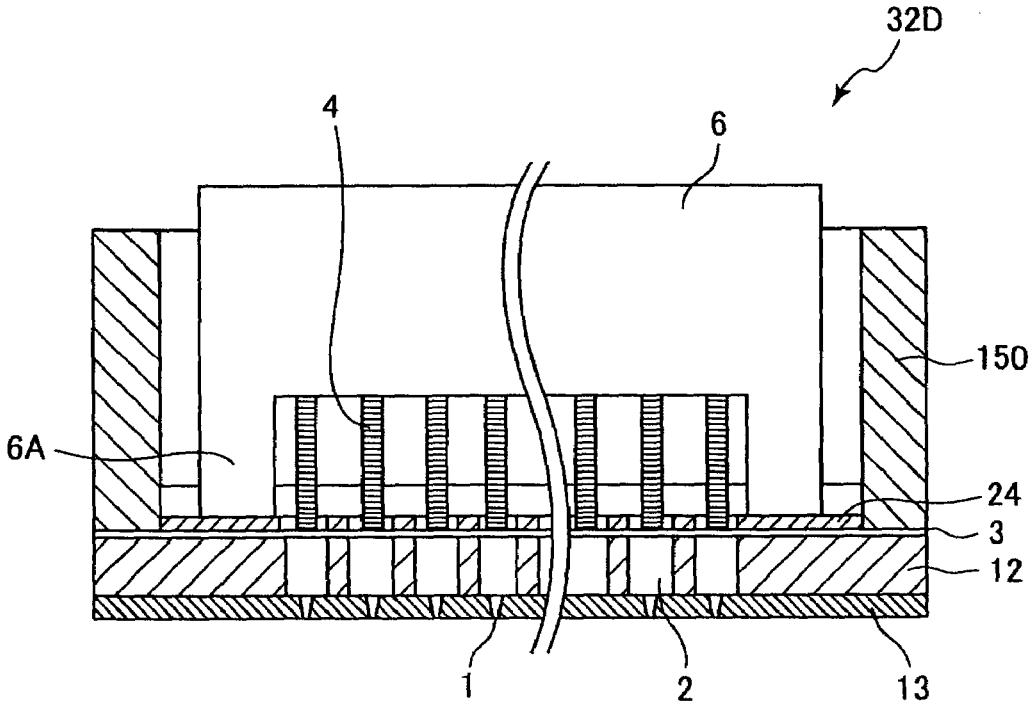
FIG. 20 is a cross-sectional view showing an inkjet recording head according to a sixth embodiment of the present invention.

Next, an inkjet head 32D according to a sixth embodiment of the present invention will be described with reference to FIG. 20. The inkjet head 32D is similar to the inkjet head 32C of the fifth embodiment, except that the inkjet head 32D is provided with protrusions 6A on both sides of the piezoelectric element fixing plate 6 in place of the dummy piezoelectric elements 4A. This configuration also provides the same effects as for the inkjet head 32C. Further, because the piezoelectric element fixing plate 6 has greater rigidity than the dummy piezoelectric elements 4A, the piezoelectric element fixing plate 6 is even less likely to be damaged by unevenness in the load applied when adhering the protrusions 6A to the lower surface A.

It should be noted that because the piezoelectric element fixing plate 6 has a higher rigidity than the piezoelectric elements 4, the protrusions 6A of the piezoelectric element fixing plate 6 should be ground down first. Then, the tip ends of the piezoelectric elements 4 are ground down to make a predetermined height difference between the protrusions 6A and the piezoelectric elements 4. By grounding down the piezoelectric element fixing plate 6 and the piezoelectric elements 4 in this order, the deviation in level difference between the protrusions 6A and the piezoelectric elements 4 can be suppressed to within the range of +/−5 microns.

Next, an inkjet head 32E according to a seventh embodiment of the present invention will be explained with reference to FIGS. 21 to 23. The inkjet head 32E prints by ejecting ink droplets while moving reciprocally in the direction indicated by an arrow D and the opposite direction. In order to increase the print density of each pass of the inkjet head 32E, the pressure chambers 2 are aligned in two rows that are shifted from each other in the direction in which the rows extend by half the pitch of the orifices 1. This arranges the pressure chambers 2 in a staggered array. The inter-row distance Ln between the centers of the two rows is desirably as short as possible in order to improve print quality, such as by improving the precision in reciprocal movement of the inkjet head 32E and by reducing any error that occurs when compensating for the difference in ejection timing between the two rows. However, if the inter-row distance Ln is too short, then the adjacent piezoelectric elements 4 are only separated by an extremely small space in the lengthwise direction L. This makes difficult to dispose the above-described chamber support plate 24 in such a small space.

Figure 22:
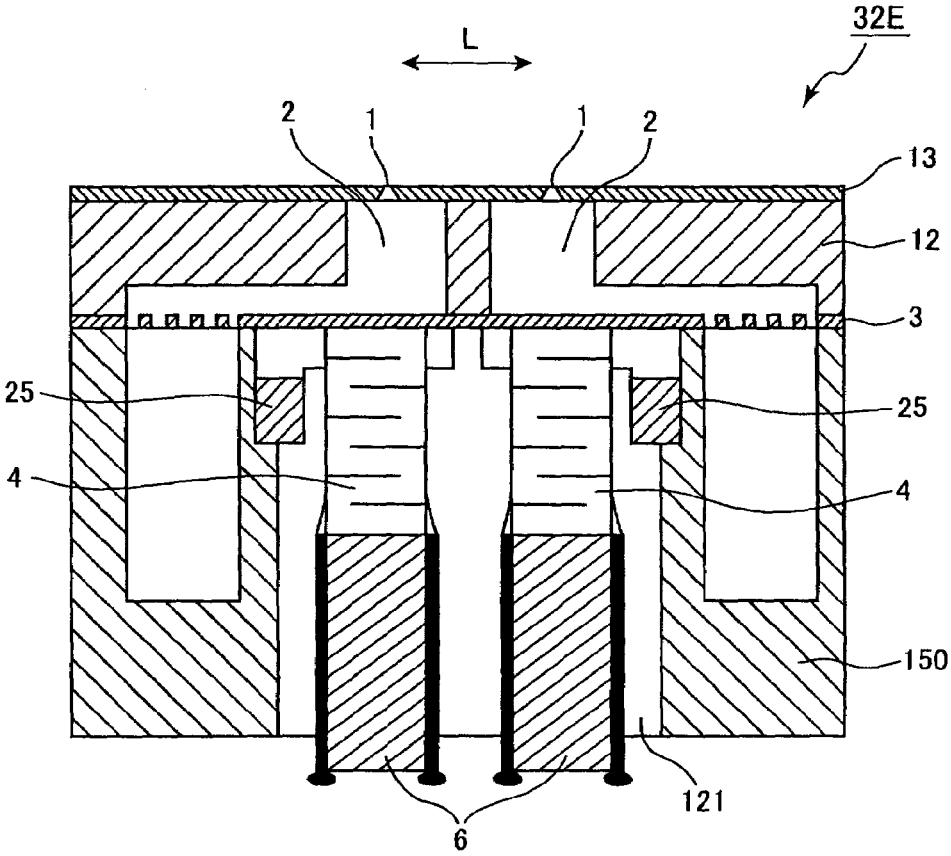
FIG. 22 is a cross-sectional view taken along line XXII—XXII of FIG. 21.

Further, as shown in FIG. 22, the opening 121 formed in the housing 150 of the inkjet head 32E is about twice as large as the opening 121 of the recording head formed with a single row of pressure chambers 2. Therefore, the chamber plate 70 will deform much more greatly by the displacement force of the piezoelectric elements 4. Moreover, if two piezoelectric elements 4 that confront each other in the lengthwise direction L are driven substantially simultaneously, then the displacement force is twice as great so that the chamber plate 70 deforms even more greatly.

Figure 23:
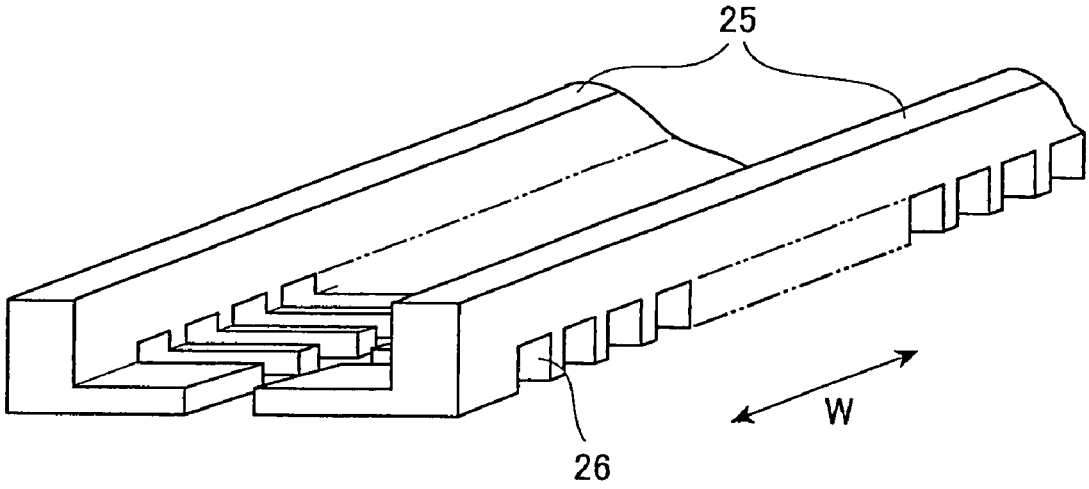
FIG. 23 is a perspective view showing a chamber support plate according to the seventh embodiment.

In order to overcome such problems, a pair of chamber plates 25 shown in FIG. 23 are used in the inkjet head 32E. The chamber plates 25 each have an L-shape in cross section and are formed with a plurality of slits 26 in a comb shape. The chamber plates 25 are arranged to face each other and shifted in the widthwise direction W by a half pitch distance in the same manner as the pressure chambers 2. The chamber plates 25 are then fixed in the recesses 121*a* of the housing 150. Then, the piezoelectric elements 4 are inserted into the slits 26 and fixed to the chamber plate 70.

Figure 21:
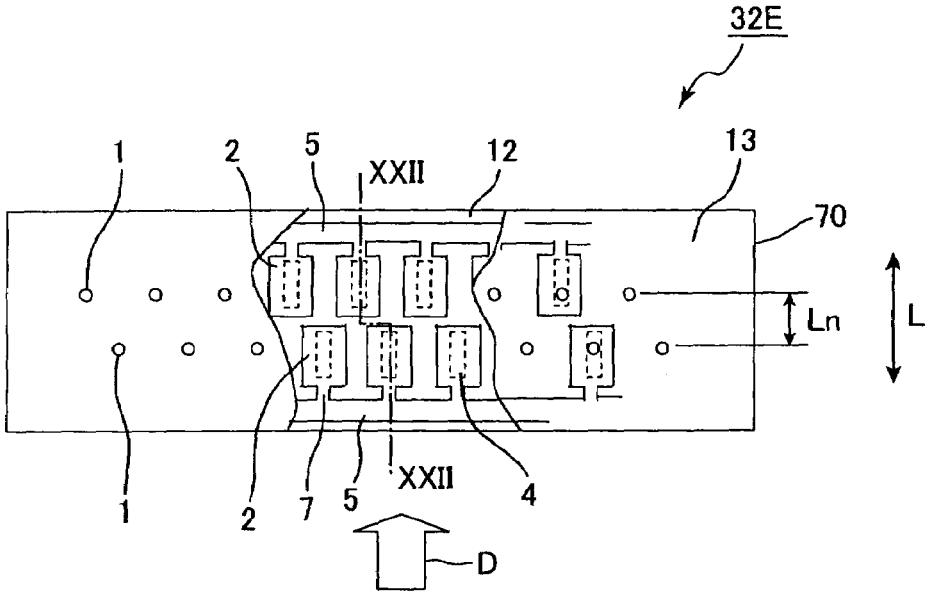
FIG. 21 is a bottom view showing an inkjet recording head according to a seventh embodiment of the present invention.

Because the chamber plates 25 are formed in L-shaped members, the chamber plates 25 can be easily arranged to match the shifted arrangement of the pressure chamber rows shown in FIG. 21. That is, the chamber plates 25 need merely be shifted from each other by an amount that corresponds to the shift between the pressure chamber rows. Also, the chamber plates 25 can be used even when the inter-row distance Ln is quite small. Therefore, the rigidity of the chamber plate 70 can be maintained quite high. It should be noted that the slits 26 can be easily formed at a high density using a dicing saw and a wire saw in the same manner as with the grooves 24*b*.

While the invention has been described in detail with reference to the specific embodiments thereof, it would be apparent to those skilled in the art that various changes and modifications may be made therein without departing from the spirit of the invention.

Figure 24:
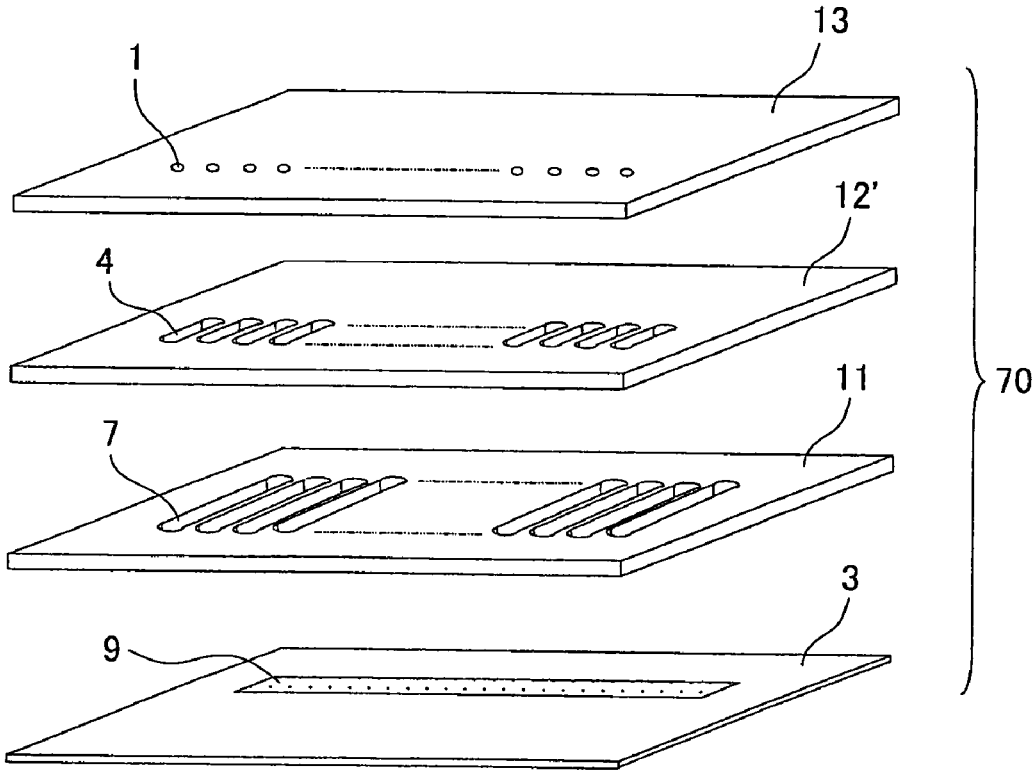
FIG. 24 is an exploded view showing another chamber support plate usable in an inkjet recording head according to the present invention.

For example, the piezoelectric layers of the piezoelectric elements 4 need not be d33 actuated, but could be d31 actuated. Also, as shown in FIG. 24, the chamber plate 70 may include the orifice plate 13, a pressure chamber plate 12' formed with pressure chambers 2, an restrictor plate 11 formed with restrictors 7, and the diaphragm 3.

The embodiments describe the present invention applied to the inkjet recording device 100, which is a compact, serial scan, table-top unit. However, the present invention may be applied to other types of printers, such as a wide-format printer for printing posters and other large-sized media or a line-type inkjet recording device including a plurality of recording heads. Also, the thickness of the housing, the depth of grooves, or other specific dimensions described in the embodiments are merely for illustration and are not to be taken as limitations of the present invention.

The present invention can be applied to other devices besides printing devices. For example, the present invention can be applied to heads used in inkjet type three-dimensional molding processes or dispensers used in industry and the like.

Figure 1:
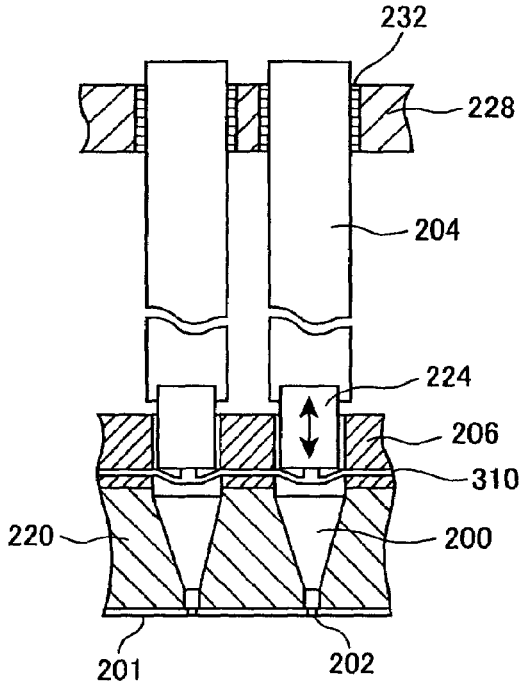
FIG.1 RELATED ART
FIG. 1 is a cross-sectional view showing an example of a conventional inkjet recording head.
Figure 2:
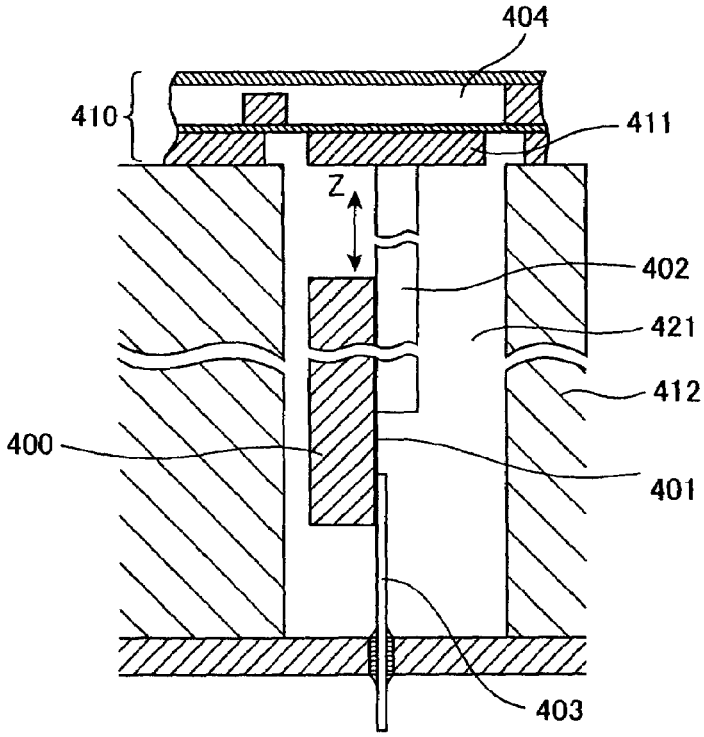
FIG.2 RELATED ART
FIG. 2 is a cross-sectional view showing another example of a conventional inkjet recording head.

In a manner similar to the island 411 indicated in FIG. 2, a projection may be formed on the region of the pressure chamber plate 12 that the piezoelectric elements 4 abuts in order to achieve more consistent ink droplet ejection.

What is claimed is:

1. An inkjet recording head comprising:

a pressure chamber plate formed with a plurality of pressure chambers filled with ink, the pressure chambers being aligned in a row that extends in a first direction;

a diaphragm adhered to the pressure chamber plate;

a housing having a first surface and a second surface opposing the first surface, the first surface being adhered to the diaphragm, the first surface being formed with a plurality of first grooves that extend in a second direction perpendicular to the first direction, the first grooves confronting the pressure chambers with the diaphragm interposed between the first grooves and the pressure chambers, the second surface being formed with a second groove that extends in the first direction, the first grooves intersecting the second groove at positions that confront the pressure chambers, wherein a plurality of through holes that extend from the first surface through to the second surface of the housing are formed where the first grooves intersect the second groove; and a plurality of actuators housed in the through holes, one end of each actuator being adhered to the diaphragm.

2. The inkjet recording head as claimed in claim 1, wherein the first grooves are filled with resin except at positions of the through holes, and the resin has a surface that shares the same plane with the first surface of the housing.

3. The inkjet recording head as claimed in claim 1, wherein the first grooves of the housing are formed using a dicer.

4. The inkjet recording head as claimed in claim 1, wherein the first grooves of the housing are formed using a wire saw.

5. An inkjet recording device comprising a head unit including a plurality of inkjet recording heads as claimed in claim 1, the plurality of inkjet recording heads being aligned in a row.

6. An inkjet recording head comprising:

a pressure chamber plate formed with a plurality of pressure chambers filled with ink, the pressure chambers being aligned in a row that extends in a lengthwise direction;

a diaphragm adhered to the pressure chamber plate;

a housing having a first surface adhered to the diaphragm, the first surface of the housing being formed with a plurality of punched through holes at positions corresponding to the pressure chambers with the diaphragm interposed between the through holes and the pressure chambers, the second surface being formed with a groove that extends in the first direction, the punched through holes communicating with the groove at positions that confront the pressure chambers with the diaphragm interposed between the punched through holes and the pressure chambers; and a plurality of actuators disposed in the through holes, one end of each actuator being adhered to the diaphragm.

* * * * *